US006406567B1

(12) United States Patent
Haszler et al.

(10) Patent No.: US 6,406,567 B1
(45) Date of Patent: Jun. 18, 2002

(54) STRESS RELIEVING OF AN AGE HARDENABLE ALUMINIUM ALLOY PRODUCT

(75) Inventors: Alfred Johann Peter Haszler, Vallender; Alfred Ludwig Heinz, Niederahr; Otmar Martin Müller, Koblenz, all of (DE)

(73) Assignee: Corus Aluminium Walzprodukte GmbH, Koblenz (DE)

( * ) Notice: Subject to any disclaimer, the term of this patent is extended or adjusted under 35 U.S.C. 154(b) by 0 days.

(21) Appl. No.: 09/671,711

(22) Filed: Sep. 28, 2000

Related U.S. Application Data

(62) Division of application No. 08/990,028, filed on Dec. 12, 1997.

(30) Foreign Application Priority Data

Dec. 16, 1996 (EP) ..... 96203563

(51) Int. Cl.[7] ..... C22C 21/00
(52) U.S. Cl. ..... 148/415; 148/416; 148/417
(58) Field of Search ..... 148/415, 416, 148/417, 437, 438, 439, 440

(56) References Cited

U.S. PATENT DOCUMENTS

| | | | | |
|---|---|---|---|---|
| 4,294,625 | A | | 10/1981 | Hyatt et al. |
| 4,968,359 | A | | 11/1990 | Hebel, Jr. et al. |
| 5,277,719 | A | * | 1/1994 | Kuhlman et al. ..... 148/694 |
| 5,413,650 | A | | 5/1995 | Jarrett et al. |

FOREIGN PATENT DOCUMENTS

| | | |
|---|---|---|
| GB | 2025818 | 1/1980 |
| JP | 54102214 | 8/1979 |
| JP | 54102214 A2 * | 8/1979 |
| JP | 03002359 | 1/1991 |
| JP | 04187747 | 7/1992 |
| WO | 9524514 | 9/1995 |

OTHER PUBLICATIONS

Altschuler, et al., "Relief of Residual Stresses in a High–Strength Aluminum Alloy by Cold Working", ASTM Spec. Tech. Publ. (1988) (from the text Mechanical Relaxation of Residual Stresses, edited by Leonard Mordfin), 19–29, ISSN: 0066–0558, 1988.
Metals Handbook, vol. 14, ASM International, pp. 680–687 (1988).

* cited by examiner

*Primary Examiner*—George Wyszomierski
*Assistant Examiner*—Janelle Combs Morillo
(74) *Attorney, Agent, or Firm*—Stevens, Davis, Miller & Mosher, LLP

(57) ABSTRACT

Stress relieving of an age hardenable aluminium alloy product after solution heat treatment and quenching, is carried out by a permanent cold plastic deformation applied by the steps:

(a) applying a stress-relieving cold mechanical stretch to said product, and (b) applying a stress-relieving cold compression to said product.

This combined treatment gives improved strength and toughness and at least comparable distortion after machining.

23 Claims, No Drawings

STRESS RELIEVING OF AN AGE HARDENABLE ALUMINIUM ALLOY PRODUCT

This is a divisional of U.S. patent application Ser. No. 08/990,028, filed Dec. 12, 1997, incorporated herein by reference in its entirety.

BACKGROUND OF THE INVENTION

1. Field of the Invention

The invention relates to a method of stress relieving an age hardenable aluminium alloy product by a permanent cold plastic deformation operation after solution heat treatment and quenching. The invention also relates to a stress relieved product of an age hardenable aluminium alloy, and to uses of such a product.

2. Description of the Prior Art

Manufacture of age hardenable aluminium alloy products requires solution heat treatment and quenching of the product. Since residual stresses due to the quenching operation do not allow for machining operations without simultaneous distortion of the machined parts, the products are stress relieved. In case of flat products (e.g. rolled plate) this has been accomplished by a stretching operation using a permanent plastic deformation of a few percent of the original dimension. Usually this stretching is done in the length direction which is normally also the rolling direction.

U.S. Pat. No. 4,294,625 for example describes a process in which aluminium alloy is cast, hot worked into plate, solution treated, quenched, pre-aged, cold rolled to reduce thickness by 11±2% and then stretched for stress relieving prior to ageing. The product is for use in aircraft. WO 95/24514 similarly briefly mentions stretching a quenched thick aluminium alloy product to improve flatness and reduce residual stress. JP-A-54-102214 describes manufacture of aluminium alloy pipe or rod with low residual stress, by hardening followed by stretch levelling by 0.5–1.0%, then roll levelling and further stretch levelling by 0.5–1.0%, followed by tempering at 210–250° C. for 1–2 hours to relieve stress further.

It has also been proposed to employ cold compression as a stress-relieving step. GB-A-2025818 discusses manufacture of aluminium alloy rings by hot ring rolling, solution heat treatment, quenching, cold rolling for stress relieving and ageing. The diameter expansion in the cold rolling is 1 to 3%. Similarly JP-A-3-2359 describes cold compression of a complex shaped hollow conical billet of aluminium alloy, after solution heat treatment and prior to ageing. JP-A-4-187747 describes two-axis cold compression carried out on an aluminium alloy block of complex shape having insert parts located in apertures.

In conventional cold stretching, if the cross-section of the product (plate) is large (e.g. very thick or very wide plate) the strength of the stretcher machine may be insufficient to achieve the desired stretching degree. This of course depends not only on the dimensions of the plate but also on the plate alloy or—more precisely—on the flow stress of the plate material in the solutionized and quenched condition.

SUMMARY OF THE INVENTION

The object of the invention is therefore to provide a method of stress relieving of an age hardenable aluminium alloy product which is especially applicable to alloy product of large cross-section.

According to the invention in one aspect there is provided a method of stress relieving an age hardenable aluminium alloy product after solution heat treatment and quenching, comprising applying a permanent cold plastic deformation by the steps of:

(a) applying a stress-relieving cold mechanical stretch to the product, and (b) applying a stress-relieving cold compression to the product.

In another aspect, the invention provides a method of manufacture of a product of an age hardenable aluminium alloy comprising the steps of:

(i) casting said age hardenable alloy (ii) shaping the cast alloy to form a shaped product (iii) solution heat treating said shaped product (iv) quenching the solution heat treated product (v) performing stress relieving of the quenched product by applying a permanent cold plastic deformation by the steps of (a) applying a stress-relieving cold mechanical stretch to said product, and (b) applying a stress-relieving cold compression to said product.

In this method, the age hardening may be natural ageing or artificial ageing.

In a preferred embodiment the product is a plate product, having length, width and thickness directions, which is stretched in the length direction and compressed in the thickness reduction.

It has been found, as will be shown below, that replacement of the conventional mechanical stretching as a stress relieving method by cold compression alone results in loss of strength and toughness properties of the final product, although distortion after machining is improved. By applying combined stretching and compression the loss of properties is recovered while at the same time the improved distortion is retained.

To obtain full advantage of the invention the stress relieving permanent deformation by stretching, defined as the permanent elongation in the direction of stretching should be not more than 15%, should more preferably be in the range of 0.3–5%, and most preferably be in the range of 0.5–3%.

Similarly preferably the stress relieving permanent deformation by compression, defined as the permanent reduction in the direction of compression should be in the range of 0.2–5%, and should more preferably be in the range of 0.5–3%.

In practice the cold compression may be given by forging, e.g. by a forging tool in overlapping steps. The stress relieving stretching of the product preferably takes place before the compression. The deformation is preferably given before substantially any age hardening after quenching.

Full advantage of the invention is obtained when the product is a thick plate having a final thickness of 2 inches (5 cm) or more, preferably 4 inches (10 cm) or more and most preferably 6 inches (15 cm) or more.

The invention is particularly effective in meeting requirements of strength and toughness properties and distortion when the aluminium alloy belongs to the Aluminium Association AA 2XXX, the AA 6XXX or the AA 7XXX series.

The invention also consists in the product of the method of the invention described above.

In another aspect the invention provides a product made of an age hardenable aluminium alloy suitable for use in an aircraft construction and being stress relieved after solution heat treatment and quenching by a combination of a cold mechanical stretching and a cold compression, having in the age hardened condition, as compared with a product which has been stress relieved by said cold mechanical stretching only but has otherwise the same manufacturing history, similar strength and toughness properties and an improved property of distortion after machining.

In still another aspect the invention provides a product made of an age hardenable aluminium alloy suitable for use in one of a tooling construction and a moulding construction and being stress relieved after solution heat treatment and quenching by a combination of a cold mechanical stretching and a cold compression, having in the age hardened condition, as compared with a product which has been stress relieved by said cold compression only but has otherwise the same manufacturing history, improved strength and toughness properties and a similar property of distortion after machining.

Preferably the distortion after machining is less than 50 $\mu$m.

DESCRIPTION OF PREFERRED EMBODIMENTS

An example of the invention and comparative examples will now be described, but the invention is not limited to the particular example given.

Experiment 1 (Comparative)

There were manufactured two 6 inch (15 cm) plates of the aluminium alloy AA 7050 T 745X by casting, homogenizing, hot rolling, solution heat treating and quenching, stress relieving (immediately after quenching) and age hardening. The manufacturing procedure for both plates was the same except for the stress relieving which for one plate was executed by a conventional mechanical stretching in the length direction of the plate and for the other plate by cold compression. The cold compression was performed in the through thickness direction in order to achieve a stress relieved or stress reduced material. The compression was performed using a forging press. Because the product (plate) was much longer than the forging tool the cold compression operation was performed in a number of steps with an overlapping zone in each step in order to guarantee that the entire volume of the product was compressed and therefore stress relieved or stress reduced.

The two plates were tested. The amount of cold deformation and the test results are shown in Table 1.

TABLE 1

| Property | | Cold deformation: Stretching 1.9–2.0% | Cold deformation: Compression 2.2–2.4% |
|---|---|---|---|
| Tensile L, s/4 | TYS [MPa] | 460 | 445 |
| | UTS [MPa] | 513 | 510 |
| | $A_{4d}$ [%] | 10.7 | 10.3 |
| Tensile LT, s/4 | TYS [MPa] | 456 | 451 |
| | UTS [MP]l | 521 | 516 |
| | $A_{4d}$ [%] | 7.7 | 8.1 |
| Tensile ST, s/2 | TYS [MPa] | 424 | 401 |
| | UTS [MPa] | 490 | 487 |
| | $A_{4d}$ [%] | 4.0 | 4.1 |
| $K_{IC}$ L-T, s/4 | [MPa $m^{0.5}$] | 26.33 | 28.34 |
| $K_{IC}$ L-T, s/4 | [MPa $m^{0.5}$] | 24.41 | 23.61 |
| $K_{IC}$ L-T, s/2 | [MPa $m^{0.5}$] | 24.22 | 24.0 |
| Machining distortion | [$10^{-6}$ m] | 70–100 | 40–50 |

L, S, T, LT, L-T, etc. denote the testing directions in accordance with ASTM E399. Tensile testing was performed in accordance with ASTM E8 and ASTM B5557. TYS is tensile yield strength. UTS is ultimate tensile strength. $A_{4d}$ is elongation at fracture for a round tensile specimen with a gauge length of four times diameter. Fracture toughness testing for $K_{Ic}$ values was performed according to ASTM B645 and ASTM E399. Machining distortion testing was carried out in accordance with Boeing Materials Specification BMS 7-323B, para. 8.6 and FIGS. 4 and 5.

This experiment shows that the cold compression results in lower distortion after machining when compared to stretched material of same history and similar level of cold deformation. At the same time it was found that the cold compressed material has a lower tensile strength both in the direction of cold compression (the thickness direction) and in the length direction. This at best results in a narrow manufacturing window to obtain the required properties.

Experiment 2

This includes another comparative example and an example of the invention.

Two identical plates similar to those used in Experiment 1 (same alloy) were made by the same procedure as in Experiment 1 except that their thickness was 8.6 inches (21.8 cm) and that the stress relieving for one plate was a cold compression in the thickness direction only and for the other plate a combination of mechanical stretching in the length direction and cold forging in the thickness direction.

Table 2 gives the deformation degrees and the results of tests on the products.

TABLE 2

| Property | | Cold deformation: cold compressed 1.6–1.9% | Cold deformation: stretched 0.6–0.7% and cold compressed 0.9–1.1% |
|---|---|---|---|
| tension L, T/4 | TYS [MPa] | 421 | 431 |
| | UTS [MPa] | 498 | 505 |
| | $A_{4d}$ [%] | 11.0 | 9.5 |
| tension LT, T/4 | TYS [MPa] | 420 | 421 |
| | UTS [MP]l | 491 | 493 |
| | $A_{4d}$ [%] | 10.0 | 10.9 |
| tension ST, T/2 | TYS [MPa] | 375 | 382 |
| | UTS [MPa] | 480 | 485 |
| | $A_{4d}$ [%] | 7.0 | 5.7 |
| $K_{IC}$ L-T, T/4 | [MPa $m^{0.5}$] | 26.2 | 28.34 |
| $K_{IC}$ L-T, T/4 | [MPa $m^{0.5}$] | 26.1 | 23.61 |
| $K_{IC}$ L-T, T/2 | [MPa $m^{0.5}$] | 21.6 | 24.0 |
| Machining distortion | [$10^{-6}$ m] | 50 | 50 |

The loss in strength experienced with a cold compression alone was avoided by the combined process both for the L and the ST testing direction. Surprisingly it was found also that the toughness level of the combined stretched/cold compressed material was much better as compared to the product cold compressed only. This effect is more pronounced for the S-L than for the T-L and the L-T testing direction. The degree of distortion after machining is virtually the same for the two different processes. Therefore the process of invention permits manufacture of large cross-sections (wide and thick) of high strength age hardenable alloys with an improved property combination with respect to strength and toughness and simultaneously a similar level of distortion after machining when compared to the material which is cold compressed only, but otherwise has the same manufacturing history.

What we claim is:

1. A stress relieved rolled product made of age hardenable aluminium alloy, said product being subjected to a process comprising solution heat treatment, then quenching and after quenching to stress-relieving by applying a permanent cold plastic deformation comprising the steps of:

(a) applying a stress-relieving cold mechanical stretch to said product wherein permanent deformation, defined as the permanent elongation in the direction of stretching, is in the range 0.3–5%, and (b) applying a stress-relieving cold compression to said product, wherein permanent deformation, defined as the permanent reduction in the direction of compression, is in the range 0.2–5%;

wherein the distortion after machining is less than 50 $\mu$m and said product is a thick plate having a final thickness of at least 6 inches.

2. A product according to claim 1, wherein said step (a) is performed before said step (b).

3. A product according to claim 1, wherein said steps (a) and (b) are performed following quenching substantially before age hardening has taken place.

4. A product according to claim 1, wherein said product is a plate having a length direction and a thickness direction, said mechanical stretch being applied in said length direction and said compression being applied in aid thickness direction.

5. A product according to claim 1, wherein said permanent deformation in step (a) is in the range 0.5–3%.

6. A product according to claim 5, wherein said permanent deformation step (b) is in the range 0.5–3%.

7. A product according to claim 1, wherein in step (b) said cold compression is applied by a forging tool in overlapping steps.

8. A product according to claim 1, wherein the aluminium alloy of said product belongs to one of the AA 2XXX, AA 6XXX and AA 7XXX series.

9. A product according to claim 1, wherein said permanent deformation in step (a) is in the range 0.5–0.7%.

10. A product according to claim 1, wherein said permanent deformation in step (b) is in the range 0.5–1.1%.

11. A product according to claim 1, wherein said permanent deformation in step (b) is in the range 0.9–1.1%.

12. A product according to claim 1, wherein said final thickness is in the range from 6 to 8.6 inches.

13. A product according to claim 1, wherein said permanent deformation in step (b) is in the range 0.5–3%.

14. A product made from an age hardenable aluminium alloy suitable for use in an aircraft construction and being stress relieved after solution heat treatments and quenching by a process comprising a combination of cold mechanical stretching and a cold compression, having in the age hardened condition, as compared with a product which has been stress relieved by said cold mechanical stretching only but has otherwise the same manufacturing history, similar strength and toughness properties and an improved property of distortion after machining, wherein the distortion after machining is less than 50 $\mu$m and said product is a thick plate having a final thickness of at least 6 inches.

15. A product according to claim 14, wherein the aluminium alloy of said product belongs to one of the AA 2XXX, AA 6XXX and AA 7XXX series.

16. A product according to claim 14, wherein said permanent deformation in step (a) is in the range 0.5–0.7%.

17. A product according to claim 14, wherein said permanent deformation in step (b) is in the range 0.5–1.1%.

18. A product according to claim 14, wherein said final thickness is in the range from 6 to 8.6 inches.

19. A product made of an age hardenable aluminium alloy suitable for use in one of a tooling construction and a moulding construction and being stressed relieved after solution heat treatment and quenching by a process comprising a combination of a cold mechanical stretching and a cold compression, having in the age hardened condition, as compared with a product which has been stress relieved by said cold compression only but otherwise the same manufacturing history improved strength and toughness properties and a similar property of distortion after machining, wherein the distortion after machining is less than 50 $\mu$m and said product is a thick plate having a final thickness of at leat 6 inches.

20. A product according to claim 19, wherein the aluminium alloy of said product belongs to one of the AA 2XXX, AA 6XXX and AA 7XXX series.

21. A product according to claim 19, wherein said permanent deformation in step (a) is in the range 0.5–0.7%.

22. A product according to claim 19, wherein said permanent deformation in step (b) is in the range 0.5–1.1%.

23. A product according to claim 19, wherein said final thickness is in the range from 6 to 8.6 inches.

* * * * *